US009349338B2

(12) United States Patent
Kobayashi et al.

(10) Patent No.: US 9,349,338 B2
(45) Date of Patent: May 24, 2016

(54) DISPLAY DEVICE AND METHOD FOR DRIVING SAME

(71) Applicant: Sharp Kabushiki Kaisha, Osaka-shi, Osaka (JP)

(72) Inventors: Fumiyuki Kobayashi, Osaka (JP); Akizumi Fujioka, Osaka (JP); Asahi Yamato, Osaka (JP); Taketoshi Nakano, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/378,653

(22) PCT Filed: Feb. 22, 2013

(86) PCT No.: PCT/JP2013/054570

§ 371 (c)(1),
(2) Date: Aug. 14, 2014

(87) PCT Pub. No.: WO2013/129260

PCT Pub. Date: Sep. 6, 2013

(65) Prior Publication Data

US 2015/0029175 A1 Jan. 29, 2015

(30) Foreign Application Priority Data

Mar. 1, 2012 (JP) ..... 2012-045696

(51) Int. Cl.
*G09G 3/36* (2006.01)

(52) U.S. Cl.
CPC ..... *G09G 3/3674* (2013.01); *G09G 3/3648* (2013.01); *G09G 3/3614* (2013.01); *G09G 2300/0426* (2013.01); *G09G 2300/0876* (2013.01); *G09G 2310/0294* (2013.01); *G09G 2330/021* (2013.01); *G09G 2330/023* (2013.01)

(58) Field of Classification Search
None
See application file for complete search history.

(56) References Cited

U.S. PATENT DOCUMENTS

| | | | | |
|---|---|---|---|---|
| 8,872,836 | B2 * | 10/2014 | Rabii | G09G 5/393 345/530 |
| 2002/0093473 | A1 | 7/2002 | Tanaka et al. | |
| 2002/0180673 | A1 * | 12/2002 | Tsuda | G02F 1/136213 345/87 |
| 2005/0116960 | A1 | 6/2005 | Shioda et al. | |
| 2007/0194379 | A1 * | 8/2007 | Hosono | C23C 14/0021 257/347 |

FOREIGN PATENT DOCUMENTS

| | | | |
|---|---|---|---|
| CN | 1624740 | A | 6/2005 |
| JP | 2002-182619 | A | 6/2002 |
| JP | 2004-151222 | A | 5/2004 |
| TW | 558707 | B | 10/2003 |
| WO | 2005/088726 | A1 | 9/2005 |

OTHER PUBLICATIONS

Official Communication issued in International Patent Application No. PCT/JP2013/054570, mailed on Apr. 2, 2013.

* cited by examiner

*Primary Examiner* — Joseph Haley
*Assistant Examiner* — Emily Frank
(74) *Attorney, Agent, or Firm* — Keating & Bennett, LLP

(57) ABSTRACT

A memory access section 16 writes, in a memory (10), a received image signal, in a case where a current frame is one that is located right before a frame in a scanning signal. On the other hand, the memory access section 16 does not write, in the memory (10), a received image signal, in a case where the current frame is one that is located right before a frame in a pause period. This allows a further reduction in electric power used to write, in the memory (10), an image signal received from outside.

15 Claims, 8 Drawing Sheets

DISPLAY DEVICE AND METHOD FOR DRIVING SAME

TECHNICAL FIELD

The present invention relates to (i) a display device which carries out a pause driving and (ii) a method of driving the display device.

BACKGROUND ART

Conventionally, liquid crystal display devices have been employed for a wide variety of electronic devices. The liquid crystal display devices have the following advantages. That is, the liquid crystal display devices are thin, lightweight, and low in electric power consumption. Therefore, it is expected that utilization of the liquid crystal display devices will be more increased.

In recent years, a common object of various display devices has been to reduce electric power consumption. As one of effective techniques of attaining this object, pause driving has been suggested. A display device which carries out the pause driving does not scan its display panel in each frame in a subsequent pause period after scanning the display panel in each frame in a scanning period. In the pause period, voltages applied to respective pixels of the display panel in a previous frame are retained and, accordingly, display of an image is also maintained. This causes no scanning signal and no image signal to be supplied to the display panel in the pause period. Therefore, it is possible to correspondingly reduce electric power consumption.

Moreover, a technique has been developed which allows a further reduction in electric power consumption of a liquid crystal display device which carries out the pause driving. For example, Cited Document 1 discloses a display device capable of reducing, by stopping transmission of image data from an image memory in a pause period, electric power used for the transmission of the image data in the pause period.

CITATION LIST

Patent Literature 1

Japanese Patent Application Publication, Tokukai, No. 2002-182619 A (Publication Date: Jun. 26, 2002)

SUMMARY OF INVENTION

Technical Problem

However, according to the liquid crystal display device of Cited Document 1, it is not possible to reduce electric power used to write image data in the image memory.

The present invention has been made so as to solve the above problem. According to a display device in accordance with an embodiment of the present invention, it is possible to further reduce electric power used to write, in a memory, an image signal received from outside.

Solution to Problem

In order to attain the above object, a display device in accordance with an embodiment of the present invention includes:

a display panel including a plurality of scanning lines, a plurality of data lines which intersect with the plurality of scanning lines, and a plurality of pixels which are provided near respective intersections of the plurality of scanning lines and the plurality of data lines;

control signal output means for outputting a control signal which alternately designates (i) a scanning period in which a whole region on a screen of the display panel is scanned and which is constituted by at least one first frame and (ii) a pause period in which at least part of the region on the screen is not scanned and which is constituted by at least one second frame;

receiving means for receiving, in each of the at least one first frame and the at least one second frame, an image signal supplied from outside of the display device;

a memory having a region in which the image signal received by the receiving means is stored;

writing means for (i) writing, in the memory, the image signal received by the receiving means, in a case where a current frame is one that is located right before the at least one first frame in the scanning period and (ii) not writing, in the memory, the image signal received by the receiving means, in a case where the current frame is one that is located right before the at least one second frame in the pause period;

reading means for reading out, from the memory, the image signal stored in the memory, in the at least one first frame in the scanning period;

scanning signal output means for outputting each scanning signal to a corresponding one of the plurality of scanning lines, in the at least one first frame in the scanning period; and image signal output means for receiving the image signal read out by the reading means and outputting the image signal thus received to the plurality of data lines, in the at least one first frame in the scanning period.

For a fuller understanding of the nature and advantages of the invention, reference should be made to the ensuing detailed description taken in conjunction with the accompanying drawings.

Advantageous Effects of Invention

According to a display device in accordance with an embodiment of the present invention, it is possible to further reduce electric power used to write, in a memory, an image signal received from outside.

DESCRIPTION OF EMBODIMENTS

Embodiment 1

The following description will discuss an embodiment of the present invention with reference to FIGS. 1 through 5.

(Display Device 1)

Figure 1:
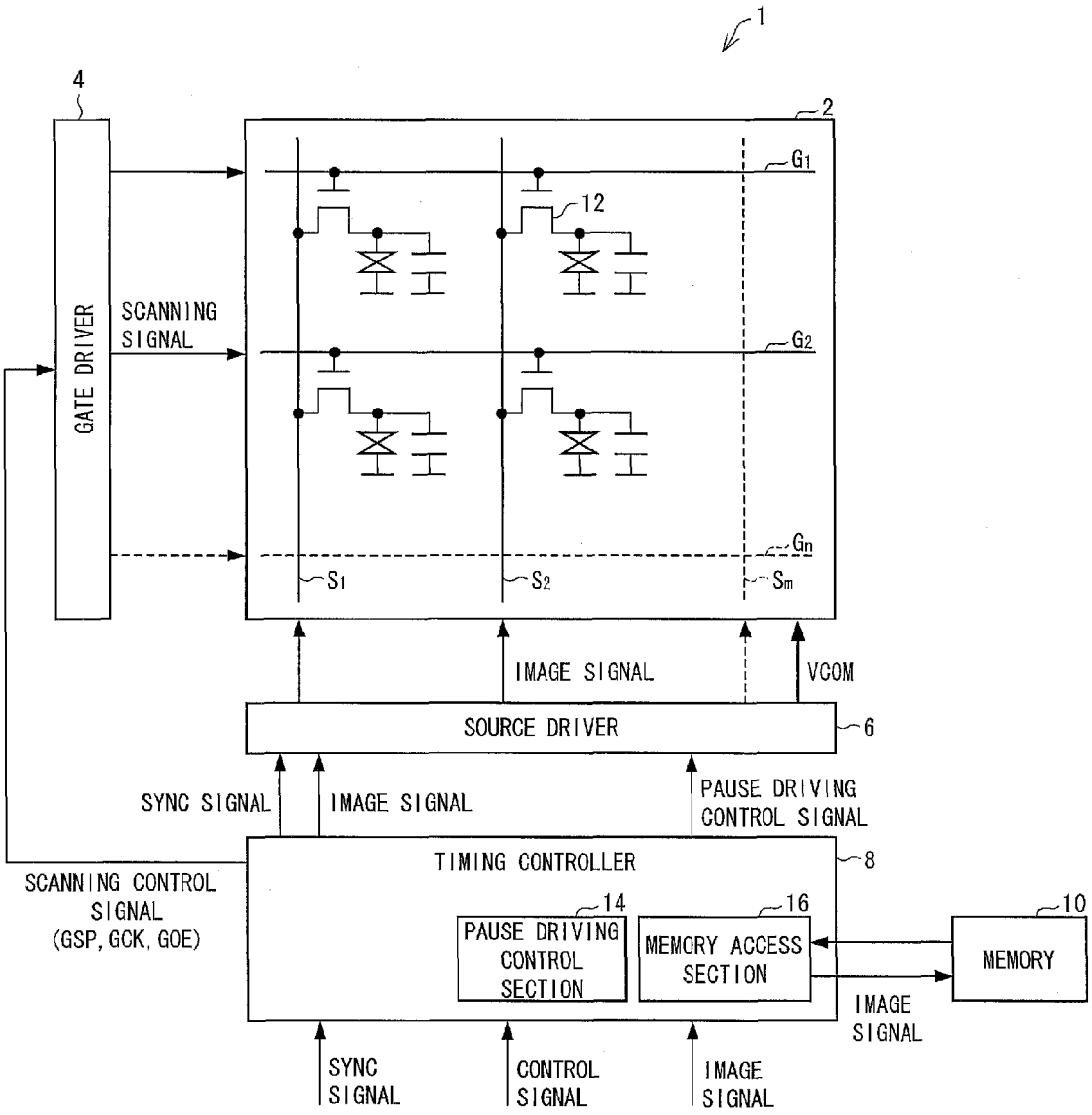
FIG. 1 is a block diagram illustrating a configuration of a main part of a display device in accordance with an embodiment of the present invention.

FIG. 1 is a block diagram illustrating, in detail, a configuration of a display device 1 in accordance with Embodiment 1. As illustrated in FIG. 1, the display device 1 includes a display panel 2, a gate driver 4 (scanning signal output means), a source driver 6 (image signal output means), a timing controller 8, and a memory 10. The timing controller 8 includes a pause driving control section 14 (control signal output means) and a memory access section 16 (writing means, reading means, and receiving means).

The display panel 2 includes a screen having a plurality of pixels arranged in a matrix manner. The display panel 2 further includes N (N is any integer) scanning lines G (gate lines) which are to be selected sequentially so that the screen is scanned line-sequentially. The display panel 2 also includes M (M is any integer) data lines S (source lines) via which an image signal is supplied to pixels corresponding to a selected one of the scanning lines G.

The scanning lines G and the data lines S intersect with each other. The plurality of pixels are provided near respective intersections of the scanning lines G and the data lines S. Each of the plurality of pixels has (i) a TFT (Thin Film Transistor) 12, which is a switching element, and (ii) a pixel electrode. In Embodiment 1, an n-channel TFT is employed as the TFT 12. The pixel electrode is connected to a drain of the TFT 12.

The display panel 2 further includes a liquid crystal layer (not illustrated), a common electrode (not illustrated), and an auxiliary electrode (not illustrated). Each of the common electrode and the auxiliary electrode faces the plurality of pixels via the liquid crystal layer. That is, the display device 1 is so-called a liquid crystal display device.

Note that G(n), illustrated in FIG. 1, indicates nth (n is an integer not less than 1 (one) and not more than N) scanning line G. For example, G(1), G(2), and G(3) indicate the first, second, and third scanning lines G, respectively. Meanwhile, S(m) indicates mth (m is an integer not less than 1 (one) and not more than M) data line S. For example, S(1), S(2), and S(3) indicate the first, second, and third data lines S, respectively.

(Flow of Driving)

A basic flow of a process will be described below, which process is carried out in a case where the display device 1 drives the display panel 2 so that an image is displayed.

First, a sync signal, a control signal, and an image signal are supplied to the display device 1 from outside of the display device 1. In the display device 1, the timing controller 8 receives those signals.

At least a clock signal, a horizontal sync signal, and a vertical sync signal, each serving as the sync signal, are supplied to the display device 1. In synchronization with the sync signal, the timing controller 8 supplies, to each of circuits, corresponding signals based on which the each of the circuits operates. Specifically, the timing controller 8 supplies, to the gate driver 4, various scanning control signals such as a gate start pulse signal GSP, a gate clock signal GCK, and a gate output enable signal GOE. The timing controller 8 supplies, to the source driver 6, various sync signals such as a source start pulse signal SSP, a source latch strobe signal SLS, and a source clock signal SCK.

The control signals each contain information on pause driving to be carried out by the display device 1. The details of the pause driving will be later described.

An image signal is a signal indicative of an image corresponding to one (1) screen in a frame. According to the display device 1, an image signal is supplied to the timing controller 8 from outside of the display device 1, in a frame just before a frame in which the image signal is actually supplied to the display panel 2. The memory access section 16 in the timing controller 8 temporarily stores, in the memory 10, the image signal thus received.

The memory 10 is a volatile memory such as an eDRAM. The memory 10 has at least a memory region for image signal in which memory region an image signal corresponding to one (1) frame (one (1) screen) is stored. In a case where the memory access section 16 writes, in the memory 10, a received image signal, the memory access section 16 writes the received image signal in the memory region for image signal.

The memory access section 16 reads out, from the memory 10, an image signal stored in the memory 10, in a frame in which the image signal is necessitated. The timing controller 8 supplies, to the source driver 6, the image signal which the memory access section 16 has read out from the memory.

The gate driver 4 starts scanning of the display panel 2 in synchronization with a gate start pulse signal GSP received from the timing controller 8. The gate driver 4 sequentially scans the scanning lines G from top down on the screen of the display panel 2. While scanning the scanning lines G, the gate driver 4 sequentially supplies each scanning signal, which has a rectangular shape and which causes the TFT 12 to be turned on, to a corresponding one of the scanning lines G in synchronization with a gate clock signal GCK for shifting a scanning line G to be selected. This causes pixels corresponding to one (1) row on the screen to be selected.

The source driver 6 calculates, based on an image signal received from the timing controller 8, voltages to be applied to respective pixels in a selected row, and then applies the voltages to the respective data lines S. This causes the image signal to be supplied to pixels (pixel electrodes) on a selected one of the scanning lines G. In accordance with a source start pulse signal SSP received from the timing controller 8, the source driver 6 stores, in a register, the image signal supplied to the pixels in synchronization with a source clock signal SCK. After storing the image signal, the source driver 6 writes the image signal in the pixel electrodes of such selected pixels, via the respective data lines S of the display device 2 in response to a next source latch strobe signal SLS. An analog amplifier (not illustrated) of, for example, the source driver 6 is used so as to write the image signal.

According to the display device 1, a common electrode (not illustrated) and an auxiliary electrode (not illustrated) are provided for each pixel on the screen. The source driver 6 applies a given common voltage (VCOM) to each common electrode.

By carrying out the above process, a given voltage (liquid crystal applied voltage) is applied to a liquid crystal layer in each of the plurality of pixels, in accordance with a voltage of the image signal supplied to the each of the plurality of pixels. In accordance with this liquid crystal applied voltage, transmittance of liquid crystal is controlled. As a result, each backlight, whose amount varies depending on the transmittance, is outputted outside of the display panel 2 through a corresponding one of the plurality of pixels. This causes each of the plurality of pixels to display luminance which varies depending on the image signal supplied to the each of the plurality of pixels. Consequently, the display panel 2 displays, on the screen, an image which varies depending on the image signal.

(Details of Liquid Crystal Applied Voltage)

Figure 2:
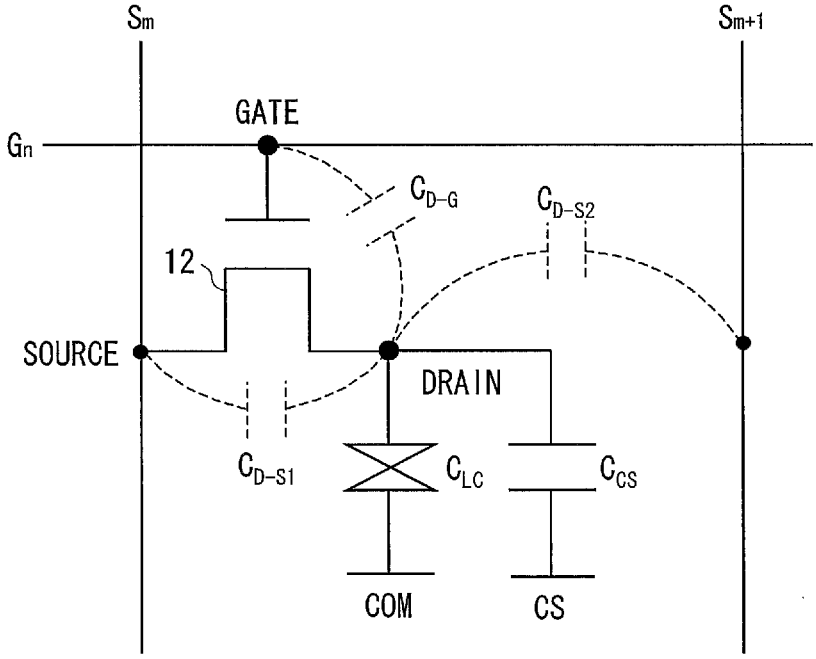
FIG. 2 is a view illustrating an equivalent circuit provided in each of pixels included in the display device in accordance with the embodiment of the present invention.

The following description will discuss, with reference to FIG. 2, details of a voltage applied to the liquid crystal in each of the plurality of pixels. FIG. 2 is a view illustrating an equivalent circuit provided in each of the plurality of pixels included in the display device 1 of Embodiment 1. According to an example illustrated in FIG. 2, a gate of a TFT 12 in a pixel is connected to a scanning line Gn. A source of the TFT 12 is connected to a signal line Sn. A drain of the TFT 12 is connected to a pixel electrode (not illustrated).

As illustrated in FIG. 2, various capacitors are formed in the pixel. For example, a capacitor $C_{D\text{-}G}$ is formed between the gate and the drain of the TFT 12. A capacitor $C_{D\text{-}S1}$ is formed between the gate and the source of the TFT 12. A capacitor $C_{LC}$ is formed between the drain of the TFT 12 and the common electrode COM. A capacitor $C_{CS}$ is formed between the drain of the TFT 12 and the auxiliary electrode CS. A capacitor $C_{D\text{-}S2}$ is formed between the drain of the TFT 12 and a signal line Sm+1.

A voltage, obtained by subtracting a feed-through voltage ΔV of the gate of the TFT 12 from a voltage (source voltage) applied to the source of the TFT 12 via a signal line Sm, is applied to the drain of TFT 12. The feed-through voltage ΔV is calculated by the following expression.

$$\Delta V=\alpha\times(V_{GH}-V_{GL})$$

where $V_{GH}$ denotes a voltage occurred while a scanning signal is being in a high state (on-state), $V_{GL}$ denotes a voltage occurred while the scanning signal is being in a low state (off-state), and α is calculated by the following expression.

$$\alpha=C_{D\text{-}G}/(C_{LC}+C_{CS}+C_{D\text{-}G}+C_{D\text{-}S1}+C_{D\text{-}S2})$$

(Details of TFT 12)

According to the display device 1 of Embodiment 1, a TFT, in which a so-called oxide semiconductor is employed as a semiconductor layer, is employed as the TFT 12 in each of the plurality of pixels included in the display panel 2. In particular, a TFT 12 is employed which employs so-called "IGZO (InGaZnOx)." The IGZO is an oxide made up of indium (In), gallium (Ga), and zinc (Zn), as an oxide semiconductor employed as a semiconductor layer. The TFT 12, which employs the oxide semiconductor, will be described below in terms of its advantages.

Figure 3:
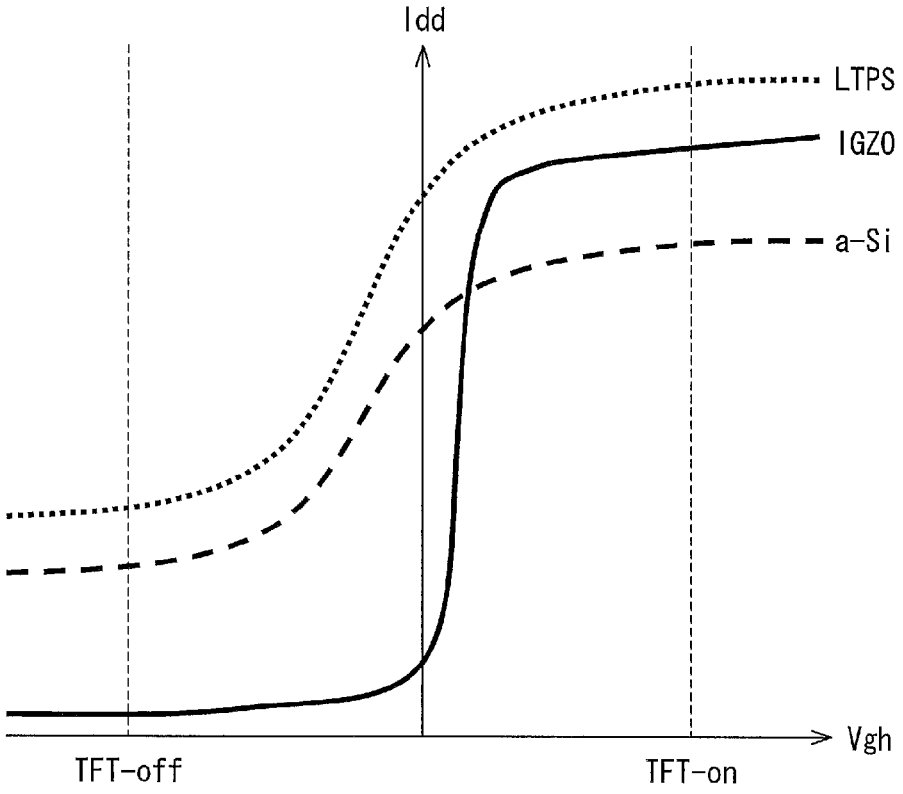
FIG. 3 is a view illustrating characteristics of respective various TFTs, which encompass a TFT employing an oxide semiconductor.

FIG. 3 is a view illustrating characteristics of respective various TFTs, which encompass the TFT 12 employing the oxide semiconductor. FIG. 3 shows the characteristics of (i) the TFT 12 which employs the oxide semiconductor, (ii) a general TFT which employs a-Si (amorphous silicon), and (iii) a general TFT which employs LTPS (Low Temperature Poly Silicon).

In FIG. 3, a horizontal axis (Vgh) indicates on-voltages applied to gates of the respective TFTs. A vertical axis (Id) indicates each electric current flowing between a source and a drain of a corresponding one of the TFTs. A period "TFT-on" indicates periods in which the TFTs are tuned on in accordance with the respective on-voltage. A period "TFT-off" indicates periods in which the TFTs are tuned off in accordance with the respective on-voltages.

(On-Characteristic)

The TFT which employs the oxide semiconductor is high in electron mobility while being turned on, as compared with the TFT which employs a-Si (see FIG. 3). Specifically, in a case of the TFT which employs a-Si, an Id electric current is 1 uA (not illustrated) while the TFT is being turned on. In contrast, in a case of the TFT which employs the oxide semiconductor, an Id electric current is approximately 20 uA to 50 uA (not illustrated) while the TFT is being turned on. It is therefore understood that the TFT which employs the oxide semiconductor is approximately 20 times to 50 times as high as the TFT which employs a-Si, in terms of electron mobility in the on-state and is accordingly extremely excellent in on-characteristic.

The display device 1 of Embodiment 1 employs, for each of the plurality of pixels, such a TFT 12 that employs the oxide semiconductor. Since the TFT 12 is thus excellent in on-characteristic, the display device 1 is capable of driving each of the plurality of pixels with the use of the TFT 12, which is smaller in size than the others. This allows a reduction in proportion of an area which is occupied by the TFT 12 in each of the plurality of pixels. That is, it is possible to increase an aperture ratio of each of the plurality of pixels, and is accordingly possible to increase transmittance of backlight. As a result, it is possible to (i) employ backlight which consumes less electric power and/or (ii) suppress luminance of backlight. This allows a reduction in electric power consumption.

Furthermore, since the TFT 12 is excellent in on-characteristic, it is possible to shorten time required for an image signal to be written in each of the plurality of pixels. This makes it possible to easily increase a refresh rate of the display panel 2.

(Off-Characteristic)

The TFT 12, which employs the oxide semiconductor, is low in leak current while being turned off, as compared with the TFT which employs a-Si (see FIG. 3). Specifically, in a case of the TFT which employs a-Si, an Id electric current is 10 pA (not illustrated) while the TFT is being turned off. In contrast in a case of the TFT 12, which employs the oxide semiconductor, an Id electric current is approximately 0.1 pA (not illustrated) while the TFT is being turned off.

It is therefore understood that the TFT 12, which employs the oxide semiconductor, is approximately a hundredth (1/100) as low as the TFT which employs a-Si, in terms of a leak current in the off-state and is accordingly extremely excellent in off-characteristic because the leak current hardly occurs. Since the TFT 12 is thus excellent in off-characteristic, the display device 1 of Embodiment 1 is capable of maintaining, for a long time, a state where an image signal is being written in the plurality of pixels of the display panel 2. It is therefore possible to carry out the pause driving (described later) while maintaining a high display quality. Moreover, it is possible to further lengthen a pause period during the pause driving.

(Pause Driving)

The display device 1 carries out so-called pause driving in order to reduce electric power consumption during its operation. The pause driving carried out by the display device 1 will be described below.

As has been described, a control signal is supplied to the display device 1 from outside of the display device 1. The pause driving control section 14 in the timing controller 8 receives such a control signal. The control signal includes (i) information indicative of the number of frames constituting a scanning period, in which a whole region on the screen of the display panel 2 is scanned and (ii) information indicative of the number of frames constituting the pause period, in which at least part of the region on the screen is not scanned. Hereinafter, the at least part of the region on the screen is referred to a pause region.

The pause driving control section 14 calculates, in accordance with a received control signal, (i) the number of the frames constituting the scanning period and (ii) the number of the frames constituting the pause period. In this case, since (i) the information indicative of the number of the frames constituting the scanning period and (ii) the information indicative of the number of the frames constituting the pause period are contained in the control signal, the pause driving control section 14 employs the numbers indicated by the respective pieces of information as (i) the number of the frames constituting the scanning period and (ii) the number of the frames constituting the pause period.

The pause driving control section 14 generates a pause driving control signal which alternately designates (i) the scanning period constituted by the calculated number of the frames and (ii) the pause period constituted by the calculated number of the frames, and then supplies the pause driving control signal to the source driver 6. In this case, the pause driving control section 14 outputs a pause driving control signal which has a value of H in each of the frames in the scanning period and has a value of L in each of the frames in the pause period. As a result, according to the display device 1, it is possible to control, from outside of the display device 1, the pause driving carried out by the display device 1.

The timing controller 8 supplies no pause driving control signal to the gate driver 4. Instead, the timing controller 8 includes, in a gate output enable signal GOE, information which specifies the scanning period and the pause period. That is, the timing controller 8 supplies, to the gate driver 4, a gate output enable signal GOE which is on in the scanning period and is off in the pause period. The gate driver 4 operates in accordance with the gate output enable signal GOE. This causes each scanning signal to be supplied to a corresponding one of the scanning lines G in the scanning period and not to be supplied to the corresponding one of the scanning lines G in the paused period. As a result, on-off control of the gate of the TFT 12 is realized in accordance with the pause driving.

The source driver 6 specifies the scanning period and the pause period in accordance with the received control signal. The source driver 6 then supplies, in each of the frames in the scanning period, an image signal to the data lines S in the entire screen of the display panel 2. In each of the frames in the pause period, the source driver 6 can but does not need to supply the image signal to each data line S in the pause region.

By thus carrying out the above process, it is possible to reduce, in the pause period, at least electric power for outputting a scanning signal for the pause region. This allows a large reduction in electric power consumption of the display device 1 in the pause period, as compared with that of the display device 1 in the driving period. As a result, the display device in accordance with Embodiment 1 of the present invention is capable of operating with lower electric power than a display device which does not carry out the pause driving. Note that it is preferable that no image signal is supplied to the data lines S in the pause period. This also makes it possible to reduce, in the pause period, electric power for outputting an image signal for the pause region. This allows a further reduction in electric power consumption of the display device 1. Note that, in the pause period, the source driver 6 can supply an image signal corresponding to black display to the data lines S for the pause region.

In each pause period, a TFT in a pixel for pause region is turned off. It follows that a voltage, which has been applied to liquid crystal in the pixel in a frame just before the pause period, is retained as it is. Display of an image is consequently maintained. That is, the pause driving is suitable for a case where an image, in which display content is partially not changed over a given number of frames, is displayed.

(Calculation of Number of Frames Based on Image Signal)

The pause driving control section 14 can calculate, based on an image signal read out from the memory 10 by the timing controller 8, (i) the number of frames constituting a scanning period and (ii) the number of frames constituting a pause period. In this case, no control signal is externally supplied to the timing controller 8. The pause driving control section 14 analyzes a content of the image signal read out from the memory 10, and then calculates, based on an image indicated by the image signal, (i) the number of the frames constituting the scanning period and (ii) the number of the frames constituting the pause period. Therefore, the numbers, to be calculated, of the frames constituting the scanning period and the pause period differ in accordance with a change in content of the image indicated by the image signal. This causes the pause driving control section 14 to generate a pause driving control signal which designates a scanning period and a pause period, each of which is constituted by a suitable number of frames which varies depending on the image signal. As a result, the display device 1 is capable of carrying out suitable pause driving in accordance with the image signal.

(Calculation of Number of Frames Based on Information Stored in Memory)

The pause driving control section 14 can calculate, based on information stored in a non-volatility memory (memory section; not illustrated), (i) the number of frames constituting a scanning period and (ii) the number of frames constituting a pause period. In this case, no control signal is supplied to the timing controller 8. Note that the pause driving control section 14 does not need to analyze an image signal.

In the non-volatility memory, (i) information indicative of the number of the frames constituting the scanning period and (ii) information indicative of the number of the frames constituting the pause period are stored in advance. The pause driving control section 14 reads out those pieces of information from the non-volatility memory, and then employs the numbers indicated by the respective pieces of information as (i) the number of the frames constituting the scanning period and (ii) the number of the frames constituting the pause period.

(Control of Memory Region)

Figure 4:
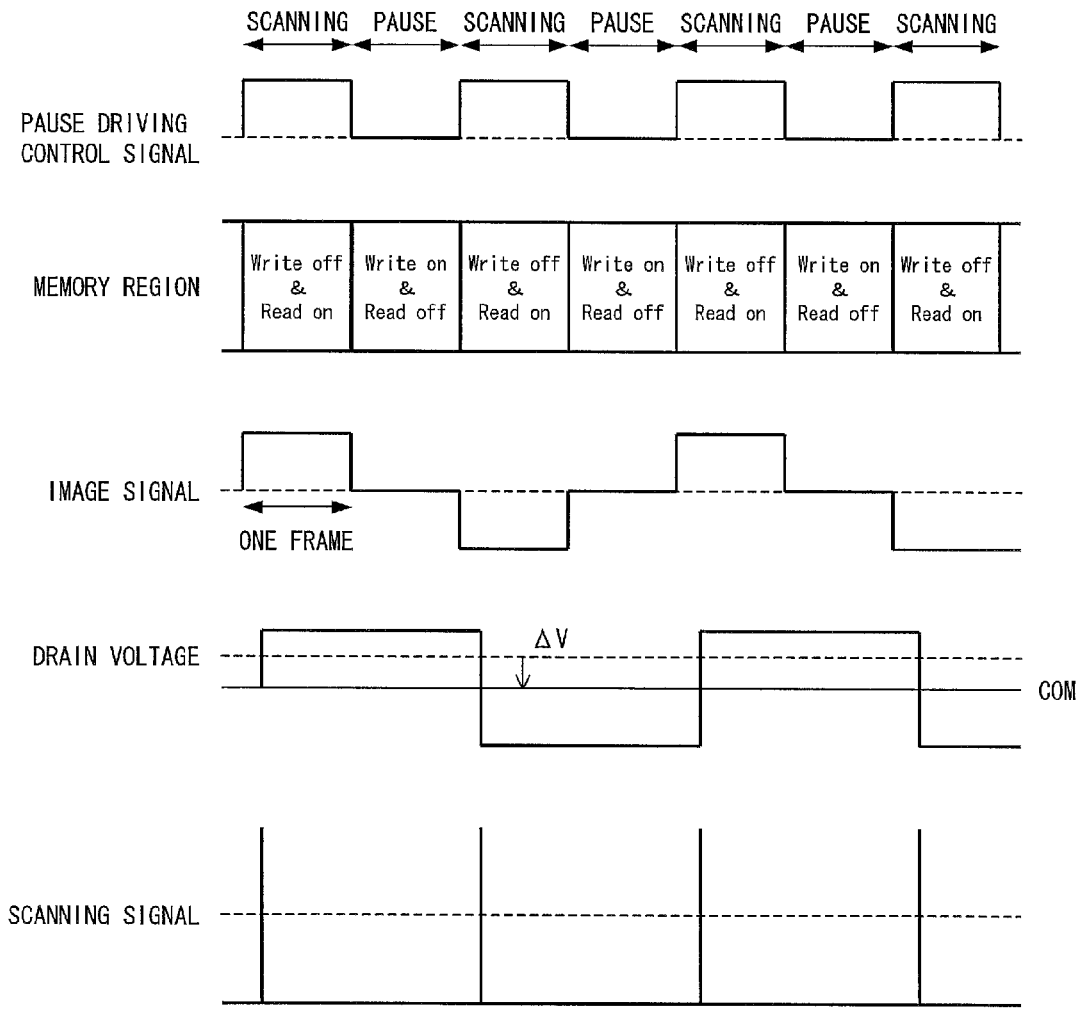
FIG. 4 is a timing diagram illustrating an example of how the display device in accordance with the embodiment of the present invention controls, in each frame, a memory region for image signal, in a case where the display device carries out pause driving.

FIG. 4 is a timing diagram illustrating an example of how the display device 1 in accordance with Embodiment 1 controls, in each frame, the memory region for image signal, in a case where the display device 1 carries out the pause driving. In FIG. 4, dotted lines each indicate a ground level. ΔV indicates a feed-through voltage as described above. According to the example illustrated in FIG. 4, the number of frames constituting a scanning period is one (1), and the number of frames constituting a pause period is one (1). That is, the scanning period and the pause period alternate with each other for each frame.

FIG. 4 illustrates a case where the whole region on the screen of the display panel 2 is a pause region. Therefore, the display device 1 does not supply, in the frame in the pause period, a scanning signal to each of the scanning lines G of the display panel 2. This causes the display panel 2 not to be scanned at all in the frame in the pause period.

The pause driving control section 14 generates a pause driving control signal in which a high level and a low level are alternated for each frame, and then supplies the pause driving control signal to the source driver 6. FIG. 4 illustrates a correlation in which a high level of the pause driving control signal indicates a scanning period, whereas a low level of the pause driving control signal indicates a pause period. Note, however, that such a correlation can be reversed. That is, the low level of the pause driving control signal can indicate the scanning period, whereas the high level of the pause driving control signal can indicate the pause period.

The source driver 6 supplies an image signal to the display panel 2 in each scanning period. In this case, the source driver 6 reverses, for each scanning period, a polarity of the image signal to be supplied. This causes a polarity of a liquid crystal applied voltage to be reversed for each scanning period. As a result, it is possible to prevent electric charges having identical polarities from being stored in the liquid crystal. This makes it possible to prevent a deterioration in display quality. Note that the source driver 6 reverses, in each frame, the polarity of the image signal for each data signal line. That is, the source driver 6 carries out so-called source-reversal driving.

Note that the source driver 6 does not supply an image signal to the data lines in each pause period. In this case, the source driver 6 can control a voltage of each of the data lines to have a ground level. Alternatively, the source driver 6 can control the voltage of each of the data lines to be in a terminal open state (high impedance level). According to the example illustrated in FIG. 4, the source driver 6 controls the voltage of each of the data lines to have a ground level.

The scanning signal is in an on-state at a start of each scanning period and thereafter remains in an off-state. In the scanning period, a voltage which is lower, by the feed-through voltage ΔV, than the source voltage of the TFT 12 is applied to the drain of the TFT 12 at a timing when the gate of the TFT 12 is turned on.

An image signal is externally supplied, for each frame, to the display device 1. The memory access section 16 in the timing controller 8 receives the image signal. The memory access section 16 writes the image signal thus received in the memory region for image signal in the memory 10, in the frame in the pause period. Meanwhile, the memory access section 16 does not read out, from the memory 10, an image signal which has been already written in the memory 10. That is, in the frame in the pause period, the memory access section 16 merely writes the image signal in the memory 10. It is therefore possible to reduce electric power necessary to read out the image signal.

In the frame in the scanning period, the memory access section 16 reads out, from the memory 10, the image signal which has been already written in the memory 10. The timing controller 8 supplies, to the source driver 6, the image signal which the memory access section 16 has read out. As a result, the source driver 6 supplies the image signal thus received to the data lines S, in the frame in the scanning period.

Meanwhile, in the frame in the scanning period, the memory access section 16 does not write a received image signal in the memory region for image signal in the memory 10. According to the example illustrated in FIG. 4, the frame in the pause period follows the frame in the scanning period. Therefore, even in a case where the image signal received in the frame in the scanning period is written in the memory 10, the image signal is not used in a next frame. That is, even in a case where the image signal received in the frame in the scanning period is not written in the memory 10, no problem arises. In addition, such a control allows, in the frame in the scanning period, a reduction in electric power used to write the image signal in the memory 10.

Another Example

Figure 5:
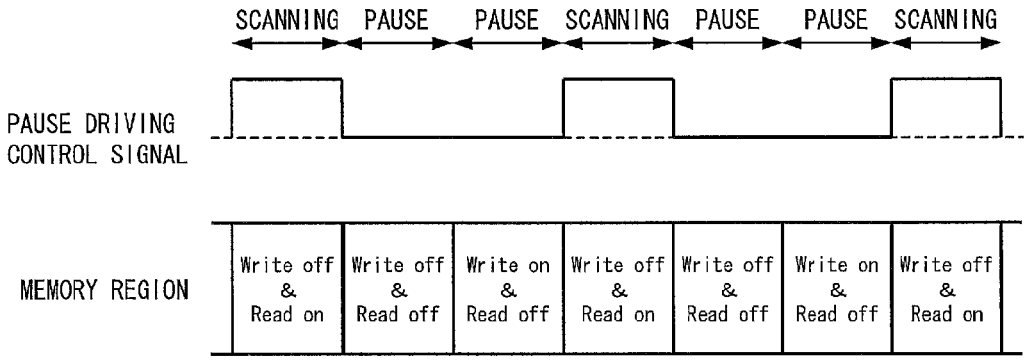
FIG. 5 is a timing diagram illustrating another example of how the display device in accordance with the embodiment of the present invention controls, in each frame, the memory region for image signal, in a case where the display device carries out the pause driving.

FIG. 5 is a timing diagram illustrating another example of how the display device in accordance with the embodiment of the present invention controls, in each frame, the memory region for image signal, in a case where the display device carries out the pause driving. According to the example illustrated in FIG. 5, the number of frames constituting a scanning period is one (1). On the other hand, the number of frames constituting a pause period is two.

According to the example illustrated in FIG. 5, how to control the memory region is different between the two frames in the pause period. Specifically, the image signal is written in the memory 10 but no image signal is read out from the memory 10 in one of the two frames, whereas no image signal is written in and read out from the memory 10 in the other of the two frames. This allows a further reduction in electric power consumption, as compared with a case where the pause period is constituted by one (1) frame as illustrated in FIG. 4.

How to control the memory region in each frame will be described below in detail. An image signal is externally supplied, for each frame, to the display device 1. The memory access section 16 in the timing controller 8 receives the image signal.

The memory access section 16 writes a received image signal in the memory region for image signal in the memory 10, in one of the frames in the pause period which one is located right before the frame in the scanning period. The image signal thus written is used to drive the display panel 2 in a next frame. Meanwhile, in the same frame, the memory access section 16 does not read out, from the memory 10, an image signal which has been already written in the memory 10. That is, the memory access section 16 merely writes the image signal in the memory 10, in one of the frames in the pause period which one is located right before the frame in the scanning period. It is therefore possible to reduce electric power necessary to read out the image signal.

The memory access section 16 does not write a received image signal in the memory region for image signal in the memory 10, in one of the frames in the pause period which one is located right before the other of the frames in the pause period. Furthermore, in the same frame, the memory access section 16 does not read out, from the memory 10, an image signal which has been already written in the memory 10. That is, the memory access section 16 does not write and read out an image signal in/from the memory 10, in one of the frames in the pause period which one is located right before the other of the frames in the pause period. It is therefore possible to reduce electric power necessary to write the image signal and electric power necessary to read out the image signal.

In the frame in the scanning period, the memory access section 16 reads out, from the memory 10, an image signal which has been already written in the memory 10. The timing controller 8 supplies, to the source driver 6, the image signal which the memory access section 16 has read out. As a result, the source driver 6 supplies the image signal thus received to the data lines S, in the frame in the scanning period.

Meanwhile, in the frame in the scanning period, the memory access section 16 does not write a received image signal in the memory region for image signal in the memory 10. According to the example illustrated in FIG. 4, the frames in the pause period follow the frame in the scanning period. Therefore, even in a case where an image signal received in the frame in the scanning period is written in the memory 10, the image signal is not used in a next frame. That is, even in a case where the image signal received in the frame in the scanning period is not written in the memory 10, no problem arises. In addition, such a control allows, in the frame in the scanning period, a reduction in electric power used to write the image signal in the memory 10.

As described above, in a case where the number of frames constituting a pause period is two, it is possible to further reduce the number of times of writing of the image signal, as compared with a case where the number of frames constituting a pause period is one (1). This allows a further reduction in electric power consumption. Note that, similar to a case where the number of frames constituting a pause period is two, also in a case where the number of frames constituting a pause period is three, it is not necessary to write and read out an image signal in/from the memory, in one of the frames in the pause period which one is located just before another one of the frames in the pause period. Therefore, as the number of frames constituting a pause period increases, it is possible to further reduce the number of times of writing of the image signal in the memory. This allows a further reduction in electric power consumption.

(Summary)

As has been described, the display device 1 in accordance with Embodiment 1 does not write, in the memory 10, a received image signal, in a case where a current frame is one that is located right before a frame in the pause period. Even in a case where the image signal is not written in the memory 10, no problem arises because it is not necessary to supply the image signal to the data lines S in the pause period. That is, no problem is caused to an image displayed on the screen of the display panel 2. On the other hand, since it is not necessary to write the image signal in the memory 10, it is possible to reduce electric power necessary for the image signal to be written in the memory 10.

Embodiment 2

Figure 6:
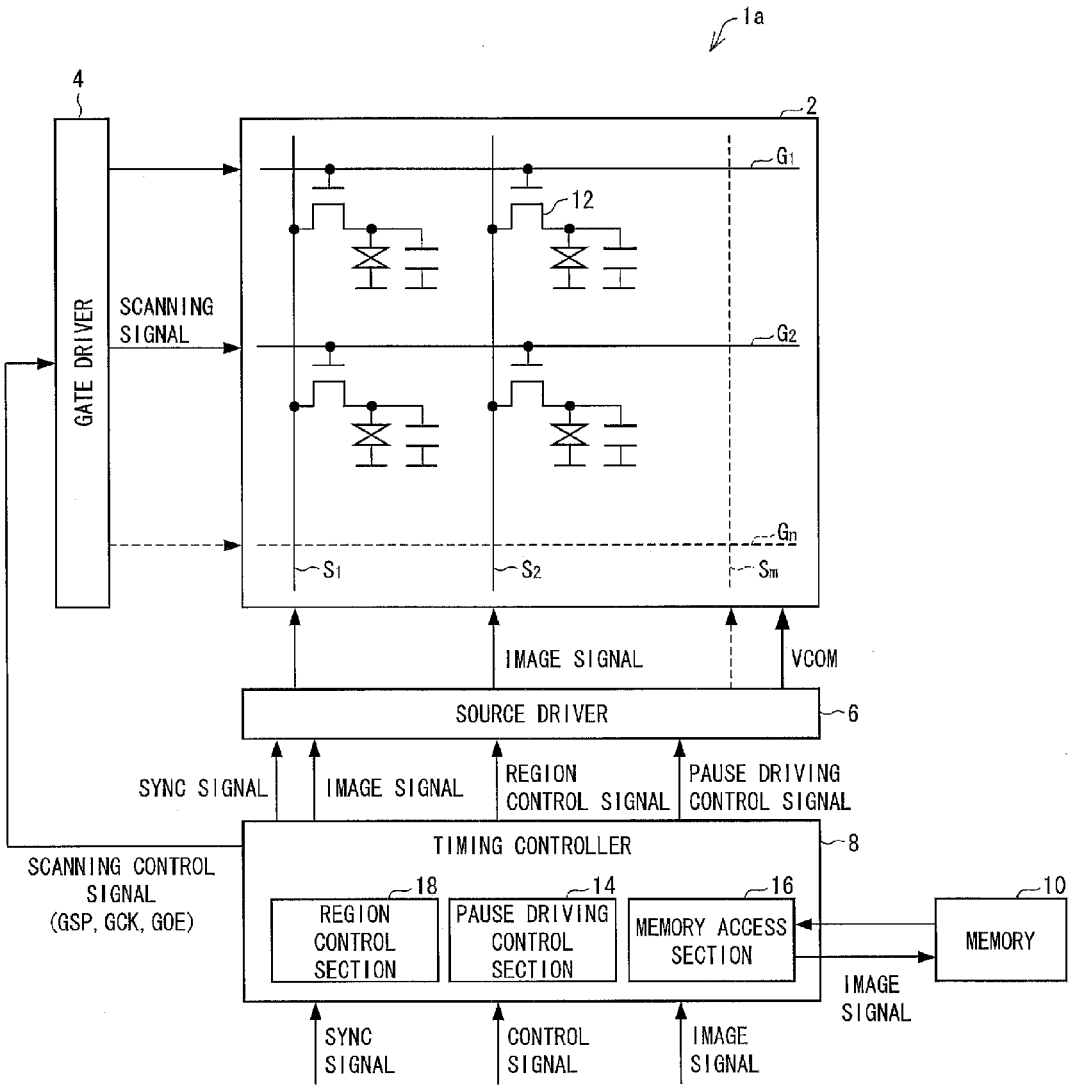
FIG. 6 is a block diagram illustrating a configuration of a main part of a display device in accordance with another embodiment of the present invention.
Figure 7:
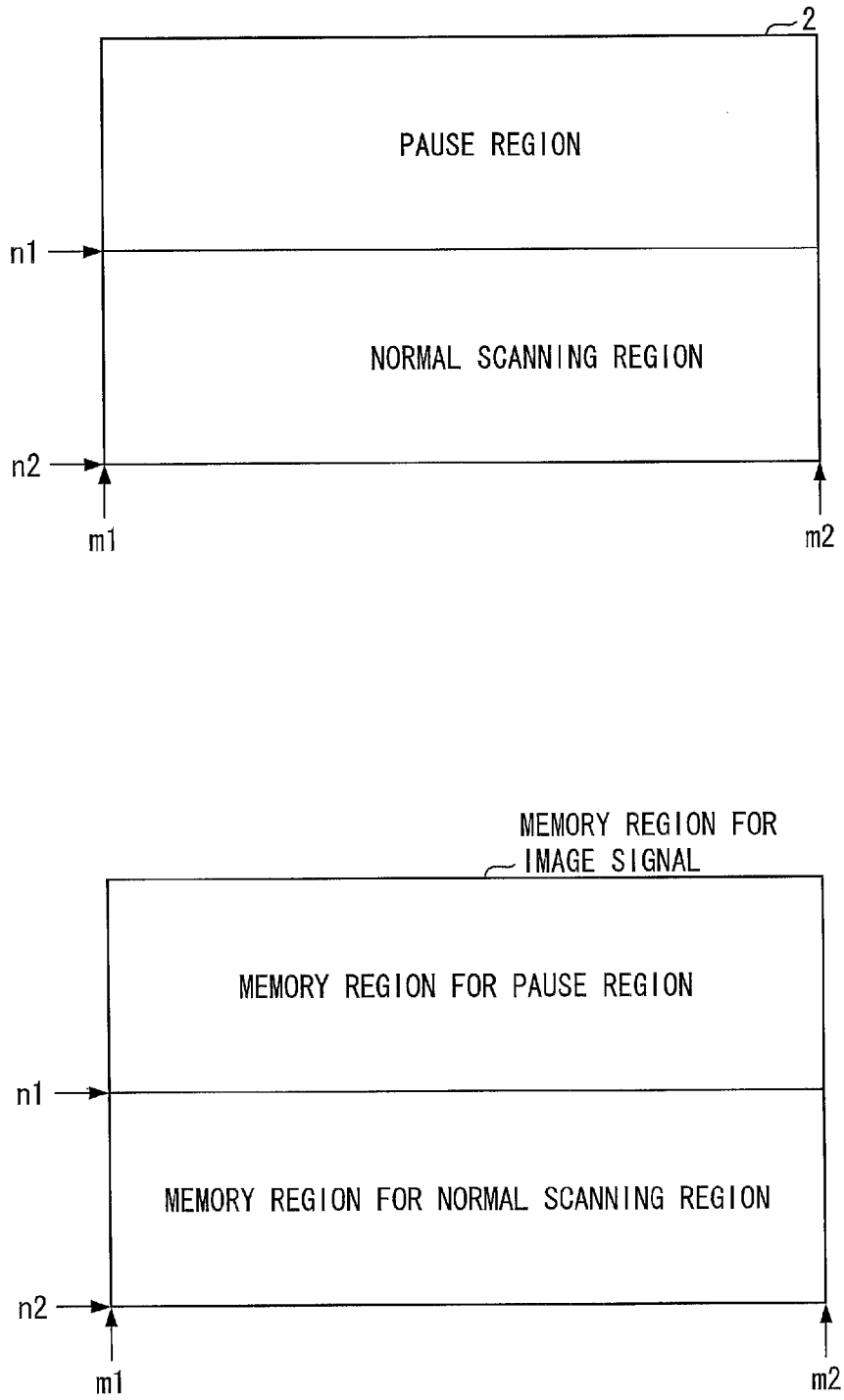
FIG. 7 is a view illustrating an example relationship between a region on a screen of a display panel and a region in a memory.
Figure 8:
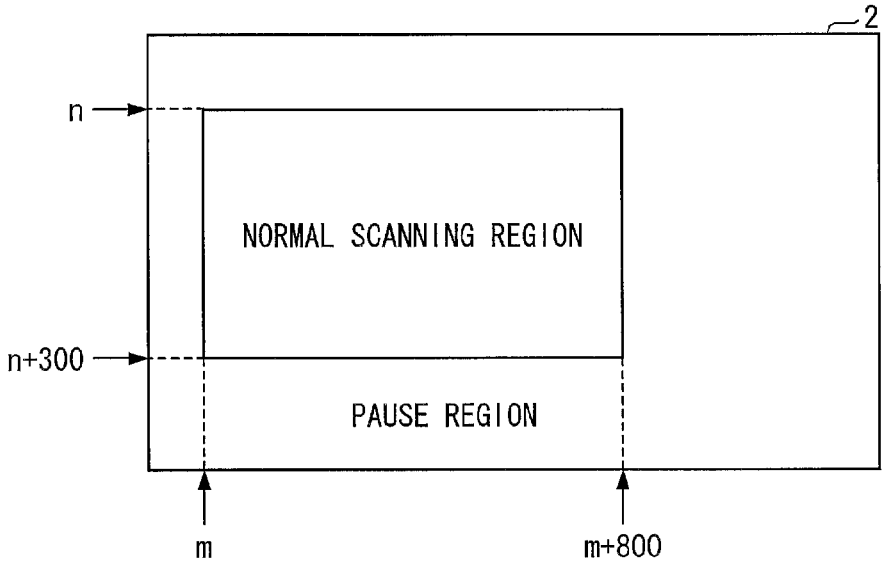
FIG. 8 is a view illustrating another example relationship between the region on the screen of the display panel and the region in the memory.
Figure 8:
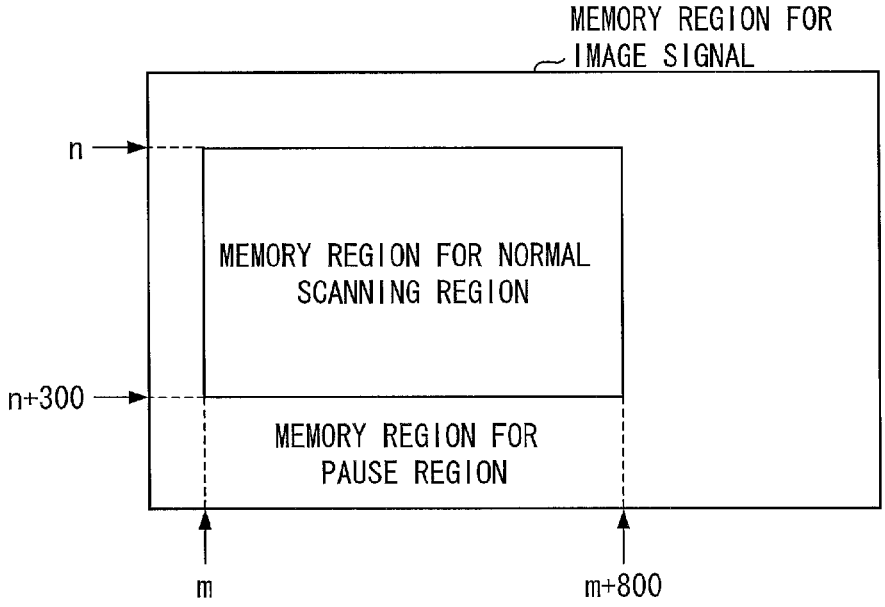

The following description will discuss Embodiment 2 of the present invention with reference to FIGS. 6 through 8. Note that identical reference numbers are given to respective members identical to those in Embodiment 1 and detailed description of the members will be omitted.

FIG. 6 is a block diagram illustrating a configuration of a main part of a display device 1*a* in accordance with Embodiment 2 of the present invention. As illustrated in FIG. 6, the display device 1*a* includes a region control section 18, in addition to the members included in the display device 1 illustrated in FIG. 1. The region control section 18 is provided in a timing controller 8.

The display device 1*a* of Embodiment 2 carries out pause driving with respect to a pause region, which is part of a region on a screen of a display panel. Meanwhile, the display device 1*a* does not carry out pause driving but carries out normal driving with respect to a normal scanning region, which is the other part of the region than the pause region. Therefore, with respect to the normal scanning region on the screen, a corresponding image signal is absolutely supplied, for each frame, to the display panel 2. On the other hand, with respect to the pause region, no corresponding image signal is supplied to the display panel 2 in each frame in a pause period, although a corresponding image signal is supplied to the display panel 2 in each frame in a scanning period. As a result, a displayed image is absolutely updated for each frame in the normal scanning region. However, in the pause region, the displayed image is merely updated in each frame in the scanning period.

FIG. 7 is a view illustrating an example relationship between a region on the screen of the display panel 2 and a region in a memory 10. According to the example illustrated in FIG. 7, an upper half part of the region of the display panel 2 indicates a pause region, whereas a lower half part of the region of the display panel 2 indicates a normal scanning region. The region control section 18 generates a region control signal which causes the pause region and the normal scanning region on the screen of the display panel 2 to be specified, and supplies the region control signal thus generated to a source driver 6. The source driver 6 specifies, in accordance with the region control signal, the pause region and the normal scanning region on the screen. This causes the source driver 6 to (i) specify part of an inputted image signal which part corresponds to the normal scanning region and (ii) supply the part of the inputted image signal to each data line S in the normal scanning region while scanning the normal scanning region.

The region control section 18 generates a region control signal which contains coordinate information used to specify the normal scanning region. According to the example illustrated in FIG. 7, the normal scanning region is demarcated by the n1th row, the n2th row, the m1th column, and the m2th column (n1, n2, m1, and m2 are each a positive integer) of the screen of the display panel 2. So, the region control section 18 generates a region control signal which contains those row numbers and column numbers.

The number of rows and the number of columns in a memory region for image signal in the memory 10 are identical to the number of rows and the number of columns, respectively, on the screen of the display panel 2. That is, the memory region for image signal which memory region can store an image signal corresponding to one (1) screen is provided in the memory 10. According to the display device 1*a* of Embodiment 2, the memory region for image signal in the memory 10 is separated into (i) a memory region for pause region (first partial region) which memory region corresponds to the pause region on the screen and (ii) a memory region for normal scanning region (second partial region) which memory region corresponds to the normal scanning region on the screen. A relative position of the pause region and the normal scanning region on the screen is equal to a relative position of the memory region for pause region and the memory region for normal scanning region in the memory region for image signal. For example, according to the example illustrated in FIG. 7, the memory region for normal scanning region is demarcated by the n1th row, the n2th row, the m1th column, and the m2th column of the memory region for image signal.

A memory access section 16 (i) does not write, in the memory region for pause region, part of a received image signal which part corresponds to the pause region and (ii) writes, in the memory region for normal scanning region, part of the received image signal which part corresponds to the normal scanning region, in a case where a current frame is one right before a frame constituting the pause period. As a result, it is not necessary to carry out a wasteful writing process with respect to the normal scanning region in a case where the pause driving is carried out with respect to the pause region. It is therefore possible to further reduce electric power consumption in a case where the pause driving is carried out with respect to part of the region on the screen of the display panel.

(Another Example of Region Setting)

FIG. 8 is a view illustrating another example relationship between the region on the screen of the display panel 2 and the region in the memory 10. As illustrated in FIG. 8, the region control section 18 can alternatively generate a region control signal which defines the normal scanning region and the pause region so that the normal scanning region is arranged inside the pause region. According to the example illustrated in FIG. 8, the normal scanning region is demarcated by the nth row, the n+300th row, the mth column, and the m+800th column (n and m are each a positive integer) of the screen of the display panel 2. So, the region control section 18 generates a region control signal which contains those row numbers and column numbers.

Also according to the example illustrated in FIG. 8, a relative position of the pause region and the normal scanning region on the screen is equal to a relative position of the memory region for pause region and the memory region for normal scanning region in the memory region for image signal. That is, the memory region for normal scanning region is demarcated by the nth row, the n+300th row. the mth column, and the m+800th column of the memory region for image signal.

According to the display device 1*a*, it is possible to arrange a pause region and a normal scanning region at any respective positions on the screen of the display panel 2 (see FIGS. 7 and 8). Note, however, that, in a case where a pause region and a normal scanning region are arranged as illustrated in FIG. 8, the display panel 2 needs to be arranged to carry out scanning on a pixel basis.

[Summary]

In order to attain the above object, a display device in accordance with an embodiment of the present invention includes:

a display panel including a plurality of scanning lines, a plurality of data lines which intersect with the plurality of scanning lines, and a plurality of pixels which are provided near respective intersections of the plurality of scanning lines and the plurality of data lines;

control signal output means for outputting a control signal which alternately designates (i) a scanning period in which a whole region on a screen of the display panel is scanned and which is constituted by at least one first frame and (ii) a pause period in which at least part of the region on the screen is not scanned and which is constituted by at least one second frame;

receiving means for receiving, in each of the at least one first frame and the at least one second frame, an image signal supplied from outside of the display device;

a memory having a region in which the image signal received by the receiving means is stored;

writing means for (i) writing, in the memory, the image signal received by the receiving means, in a case where a current frame is one that is located right before the at least one first frame in the scanning period and (ii) not writing, in the memory, the image signal received by the receiving means, in a case where the current frame is one that is located right before the at least one second frame in the pause period;

reading means for reading out, from the memory, the image signal stored in the memory, in the at least one first frame in the scanning period;

scanning signal output means for outputting each scanning signal to a corresponding one of the plurality of scanning lines, in the at least one first frame in the scanning period; and image signal output means for receiving the image signal read out by the reading means and outputting the image signal thus received to the plurality of data lines, in the at least one first frame in the scanning period.

According to the above configuration, the display device in accordance with an embodiment of the present invention carries out so-called pause driving. Specifically, the display device scans the whole region on the screen of the display panel, in each frame in the scanning period. However, the display device does not scan the at least part of the region on the screen, in each frame in the pause period. This allows a large reduction in electric power consumption of the display device in the pause period, as compared with that of the display device in the scanning period. Therefore, the display device in accordance with an embodiment of the present invention is capable of operating with lower electric power than a display device which does not carry out the pause driving.

The display device in accordance with an embodiment of the present invention receives an image signal from outside. In a case where the current frame is one that is located right before a frame in the scanning period, the display device writes, in the memory, the image signal thus received. In this case, the display device reads out, from the memory, an image signal written in the memory, in the frame in the scanning period, and then supplies the image signal to the plurality of data lines. This makes it possible to normally drive the display panel in the scanning period.

On the other hand, in a case where the current frame is one that is located right before a frame in the pause period, the display device in accordance with an embodiment of the present invention does not write a received image signal in the memory. Even in a case where the image signal is not written in the memory, no problem arises because it is not necessary to supply the image signal to the plurality of data lines in the pause period. That is, no problem is caused to an image displayed on the screen of the display panel. In addition, since it is not necessary to write the image signal in the memory, it is possible to reduce electric power necessary for the image signal to be written in the memory.

As described above, according to the display device in accordance with an embodiment of the present invention, it is possible to further reduce electric power used to write, in the memory, an image signal received from outside.

In order to attain the above object, a method of driving a display device in accordance with an embodiment of the present invention is a method of driving a display device which includes a display panel and a memory, the display panel including a plurality of scanning lines, a plurality of data lines which intersect with the plurality of scanning lines, and a plurality of pixels which are provided near respective intersections of the plurality of scanning lines and the plurality of data lines, the memory having a region in which an image signal is stored, the method comprising the steps of:

(a) outputting a control signal which alternately designates (i) a scanning period in which a whole region on a screen of the display panel is scanned and which is constituted by at least one first frame and (ii) a pause period in which at least part of the region on the screen is not scanned and which is constituted by at least one second frame;

(b) receiving, in each of the at least one first frame and the at least one second frame, the image signal supplied from outside of the display device;

(c) (i) writing, in the memory, the image signal received in the step (b), in a case where a current frame is one that is located right before the at least one first frame in the scanning period and (ii) not writing, in the memory, the image signal received in the step (b), in a case where the current frame is one that is located right before the at least one second frame in the pause period;

(d) reading out, from the memory, the image signal stored in the memory, in the at least one first frame in the scanning period;

(e) outputting each scanning signal to a corresponding one of the plurality of scanning lines, in the at least one first frame in the scanning period; and (f) receiving the image signal read out in the step (d) and outputting the image signal thus received to the plurality of data lines, in the at least one first frame in the scanning period.

According to the above configuration, it is possible to bring about an effect similar to that of the display device in accordance with an embodiment of the present invention.

The display device in accordance with an embodiment of the present invention is preferably arranged such that the reading means does not read out, from the memory, the image signal stored in the memory, in the at least one second frame in the pause period.

According to the above configuration, it is possible to reduce both (i) electric power necessary for an image signal to be written in the memory and (ii) electric power necessary for an image signal to be read out from the memory. It is therefore possible to further reduce electric power consumption in the pause period.

The display device in accordance with an embodiment of the present invention is preferably arranged such that the writing means does not write, in the memory, the image signal received by the receiving means, in a case where the current frame is one that is located right before the at least one second frame in the pause period and that is located in the scanning period.

According to the above configuration, it is possible to reduce electric power consumption in the frame in the scanning period.

The display device in accordance with an embodiment of the present invention is preferably arranged such that the pause period is constituted by a plurality of frames; and the writing means does not write, in the memory, the image signal received by the receiving means, in a case where the current frame is one of the plurality of frames in the pause period which one is located right before another one of the plurality of frames in the pause period.

According to the above configuration, it is possible to reduce electric power consumption in the frame in the scanning period.

The display device in accordance with an embodiment of the present invention is preferably arranged such that the at least part of the region is part of the region on the screen:

the region of the memory is separated into (i) a first partial region corresponding to the part of the region on the screen and (ii) a second partial region corresponding to other part of the region than the part of the region on the screen: and the writing means (i) does not write, in the first partial region, part of the image signal received by the receiving means which part corresponds to the part of the region and (ii) writes, in the second partial region, part of the image signal received by the receiving means which part corresponds to the other part of the region, in a case where the current frame is one right before the at least one second frame constituting the pause period.

According to the above configuration, it is possible to carry out (i) the pause driving with respect to the part of the region on the screen of the display panel and (ii) normal driving with respect to the other part of the region. In this case, it is not necessary to carry out a wasteful writing process with respect to a partial region in the memory which partial region corresponds to the part of the region on the screen to which part the pause driving is carried out. Therefore, it is possible to further reduce electric power consumption in a case where the pause driving is carried out with respect to the part of the region on the screen of the display panel.

The display device in accordance with an embodiment of the present invention is preferably arranged such that the at least part of the region is the whole region on the screen.

According to the above configuration, it is possible to further reduce electric power consumption of the display device.

The display device in accordance with an embodiment of the present invention is preferably arranged such that an oxide semiconductor is employed as a semiconductor layer of a TFT of each of the plurality of pixels. Particularly, it is preferable that the oxide semiconductor is IGZO.

According to the above configuration, since the TFT in each of the plurality of pixels is excellent in off-characteristic, it is possible to maintain, for a long time, a state where an image signal is being written in the plurality of pixels of the display panel. It is therefore possible to carry out the pause driving while maintaining a high display quality. Moreover, it is also possible to further lengthen the pause period.

The display device in accordance with an embodiment of the present invention is preferably a liquid crystal display device.

According to the above configuration, it is possible to realize a liquid crystal display device which is capable of carrying out the pause driving and which causes no image sticking to the display panel.

The present invention is not limited to the description of the embodiments, but may be altered by a skilled person in the art within the scope of the claims. That is, a new embodiment will be derived from a proper combination of technical means in the scope of the claims.

The embodiments and concrete examples of implementation discussed in the foregoing detailed description serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

It is possible to widely use a display device of the present invention as various display devices such as a liquid crystal display device which carries out a pause driving.

REFERENCE SIGNS LIST

1 Display device
2 Display panel
4 Gate driver (scanning signal output means)
6 Source driver (image signal output means)
8 Timing controller
10 Memory
12 TFT
14 Pause driving control section (control signal output means)
16 Memory access section (writing means, reading means, and receiving means)
18 Region control section

The invention claimed is:

1. A display device comprising:

a display panel including a plurality of scanning lines, a plurality of data lines which intersect with the plurality of scanning lines, and a plurality of pixels which are provided near respective intersections of the plurality of scanning lines and the plurality of data lines;

control signal output means for outputting a control signal which alternately designates (i) a scanning period in which a whole region on a screen of the display panel is scanned and which is constituted by at least one first frame and (ii) a pause period in which a pause portion of the whole region on the screen is not scanned, in which a scan portion of the whole region on the screen is scanned, and which is constituted by at least one second frame;

receiving means for receiving, in each of the at least one first frame and the at least one second frame, an image signal supplied from outside of the display device;

a memory having a region in which the image signal received by the receiving means is stored;

writing means for (i) when a current frame is one that is right before the at least one first frame in the scanning period, writing the image signal in the memory; and (ii) when the current frame is one that is right before the at least one second frame in the pause period, (a) writing the image signal in a first partial region of the memory corresponding to the scan portion and (b) not writing the image signal in a second partial region of the memory corresponding to the pause portion; and reading means for reading out, from the memory, the image signal stored in the memory, in the at least one first frame in the scanning period;

scanning signal output means for outputting each scanning signal to a corresponding one of the plurality of scanning lines, in the at least one first frame in the scanning period; and image signal output means for receiving the image signal read out by the reading means and outputting the image signal thus received to the plurality of data lines, in the at least one first frame in the scanning period.

2. The display device as set forth in claim 1, wherein:

the writing means does not write, in the memory, the image signal received by the receiving means, when the current frame is one that is right before the at least one second frame in the pause period and that is in the scanning period.

3. The display device as set forth in claim 1, wherein:

the pause period is constituted by a plurality of frames; and the writing means does not write, in the memory, the image signal received by the receiving means, when the current frame is one of the plurality of frames in the pause period that is right before another one of the plurality of frames in the pause period.

4. The display device as set forth in claim 1, wherein:

the reading means does not read out, from the memory, the image signal stored in the memory, in the at least one second frame in the pause period.

5. The display device as set forth in claim 1, wherein:

an oxide semiconductor is employed as a semiconductor layer of a TFT of each of the plurality of pixels.

6. The display device as set forth in claim 5, wherein:

the oxide semiconductor is IGZO.

7. A display device as set forth in claim 1, wherein the display device is a liquid crystal display device.

8. A method of driving a display device which includes a display panel and a memory, the display panel including a plurality of scanning lines, a plurality of data lines which intersect with the plurality of scanning lines, and a plurality of pixels which are provided near respective intersections of the plurality of scanning lines and the plurality of data lines, the memory having a region in which an image signal is stored, the method comprising the steps of:

(a) outputting a control signal which alternately designates (i) a scanning period in which a whole region on a screen of the display panel is scanned and which is constituted by at least one first frame and (ii) a pause period in which pause portion of the whole region on the screen is not scanned, in which a scan portion of the whole region on the screen is scanned, and which is constituted by at least one second frame;

(b) receiving, in each of the at least one first frame and the at least one second frame, the image signal supplied from outside of the display device;

(c) (i) when a current frame is one that is right before the at least one first frame in the scanning period, writing the image signal in memory and (ii) when the current frame is one that is right before the at least one second frame in the pause period, (A) writing the image signal in a first partial region of the memory corresponding to the scan portion and (B) not writing the image signal in a second partial region of the memory corresponding to the pause portion;

(d) reading out, from the memory, the image signal stored in the memory, in the at least one first frame in the scanning period;

(e) outputting each scanning signal to a corresponding one of the plurality of scanning lines, in the at least one first frame in the scanning period; and (f) receiving the image signal read out in the step (d) and outputting the image signal thus received to the plurality of data lines, in the at least one first frame in the scanning period.

9. A display device comprising:

a display panel including a plurality of scanning lines, a plurality of data lines which intersect with the plurality of scanning lines, and a plurality of pixels which are provided near respective intersections of the plurality of scanning lines and the plurality of data lines;

a memory that includes a region that stores an image signal supplied from outside of the display device;

a timing controller that:

outputs a control signal which alternately designates (i) a scanning period in which a whole region on a screen of the display panel is scanned and which is constituted by at least one first frame and (ii) a pause period in which a pause portion of the whole region on the screen is not scanned, in which a scan portion of the whole region on the screen is scanned, and which is constituted by at least one second frame;

receives, in each of the at least one first frame and the at least one second frame, the image signal;

(i) when a current frame is one that is right before the at least one first frame in the scanning period, writes the image signal in the memory; and (ii) when the current frame is one that is right before the at least one second frame in the pause period, (a) writes the image signal in a first partial region of the memory corresponding to the scan portion and (b) does not write the image signal in a second partial region of the memory corresponding to the pause portion; and reads out, from the memory, the image signal stored in the memory, in the at least one first frame in the scanning period;

a gate driver that outputs each scanning signal to a corresponding one of the plurality of scanning lines, in the at least one first frame in the scanning period; and a source driver that receives the image signal read out by the timing controller and that outputs the image signal thus received to the plurality of data lines, in the at least one first frame in the scanning period.

10. The display device as set forth in claim 9, wherein:

the timing controller does not write, in the memory, the image signal, when the current frame is one that is right before the at least one second frame in the pause period and that is in the scanning period.

11. The display device as set forth in claim 9, wherein: the pause period is constituted by a plurality of frames; and the timing controller does not write, in the memory, the image signal, when the current frame is one of the plurality of frames in the pause period that is right before another one of the plurality of frames in the pause period.

12. The display device as set forth in claim 9, wherein: the timing controller does not read out, from the memory, the image signal stored in the memory, in the at least one second frame in the pause period.

13. The display device as set forth in claim 9, wherein: an oxide semiconductor is employed as a semiconductor layer of a TFT of each of the plurality of pixels.

14. The display device as set forth in claim 13, wherein: the oxide semiconductor is IGZO.

15. A display device as set forth in claim 9, wherein the display device is a liquid crystal display device.

* * * * *